US005867747A

United States Patent [19]

Lynch et al.

[11] Patent Number: 5,867,747

[45] Date of Patent: Feb. 2, 1999

[54] AUTOMATIC FILM PROCESSOR

[75] Inventors: Marine D. Lynch; Richard D. Paulson, both of Beaverton, Oreg.

[73] Assignee: Wing-Lynch, Inc., Beaverton, Oreg.

[21] Appl. No.: 814,285

[22] Filed: Mar. 10, 1997

[51] Int. Cl.[6] ..... G03D 3/04; G03D 3/06

[52] U.S. Cl. ..... 396/626; 396/571; 396/625; 396/635

[58] Field of Search ..... 396/625, 626, 396/628, 633, 634, 635, 636

[56] References Cited

U.S. PATENT DOCUMENTS 3,695,162 10/1972 Wing .
3,828,172 8/1974 Schickler .
3,846,818 11/1974 Merz .
4,035,818 7/1977 King .
4,206,993 6/1980 Csepke .
4,269,501 5/1981 Griffith et al. .
4,473,283 9/1984 Bernhardt et al. ..... 396/634
4,708,451 11/1987 Wing et al. .
4,888,607 12/1989 Stutz et al. .
5,023,643 6/1991 Lynch et al. .
5,502,534 3/1996 Lynch et al. .

*Primary Examiner*—A. A. Matthews
*Attorney, Agent, or Firm*—Kolisch Harwell Dickinson McCormack & Heuser

[57] ABSTRACT

An automatic film processor is provided for developing high resolution, large sheet-format film in such a manner that fluid flow across the film will be uniform during all phases of film production, in order to avoid gradients, ridge lines and streaking sometimes associated with development of high resolution film. The film processor facilitates the uniform application of chemistry to the film by rapidly applying film-developing chemistry to the film, agitating and washing the chemistry over the film and quickly removing the chemistry from the film.

25 Claims, 11 Drawing Sheets

AUTOMATIC FILM PROCESSOR

BACKGROUND OF THE INVENTION

The present invention relates generally to a self-contained automatic film processor. More particularly, the invention concerns a compact and efficient high-quality commercial film processor that automatically supplies the required processing chemistry into a trough in which the film is developed, and then draining the spent chemicals into any one of a number of selectable solution recovery tanks.

Prior art systems have provided automated equipment for developing photographic material in which chemicals are delivered and evacuated at timed intervals. Such known processors are disclosed in the following U.S. patents: U.S. Pat. No. 4,586,805 to Bockemühl-Simon et al., for DEVICE FOR DEVELOPING OF PHOTO MATERIAL and No. Re. 34,188 to Kuzyk et al., for AUTOMATIC FILM PROCESSORS. Two of our prior systems were also disclosed in U.S. Pat. No. 5,023,643 for AUTOMATIC PHOTO PROCESSOR, and U.S. Pat. No. 5,502,534, for AUTOMATED PHOTO DEVELOPING MACHINE. The last identified patent is particularly pertinent in that it discloses a self-contained system in which chemicals are delivered and then evacuated in timed intervals, and chemicals are recovered in selected waste tanks so that they can be re-used.

While the prior systems are in many respects adequate for the development of film, more recent photograph, film, and display technology often requires a development system which is superior to that found in the prior art developers. For example, recent photograph technologies have utilized enlarged, high resolution photographs which are integrated into one another. Due to the high quality of the photography and the manner in which they are integrated, by turning the photograph from side to side, a three dimensional, moving image appears to the viewer. Or, as the viewer moves past a stationary sign, a moving three dimensional image is seen, just as though a continuous video is being played for the viewer. For example, a sign might depict the loading of the film into a camera, or it might depict an athlete performing an athletic maneuver. Because this is done without any moving parts, the images can be incorporated into an enlarged stationary sign, which can avoid the expense of and the governmental restrictions relating to video signage or signage with moving parts.

One drawback with these recent film technologies is that they require the use of extremely high resolution photographs which have been processed such that there are no gradients, ridge lines or streaking across the face of the photographs. These gradients, ridge lines and streaking can be present in existing technology as a result of non-uniform or laminar flow of chemistry across the face of the film during film development.

These technologies also often require the use of a large sheet format. In the past, the larger the sheets have been, the more difficult they have been to process. Gradients, ridge lines and streaking have also been a problem with large sheet formats, as well as the ability to even handle large format film during processing operations.

Accordingly, it is an object of the present invention to provide an automatic film processor which is capable of developing high resolution, large sheet format film in such a manner that flow across the film will be uniform during all phases of film production, in order to avoid gradients, ridge lines and streaking sometimes associated with development of high resolution film. It is a further object of the invention to come up with an automated film processor which can develop large format film often used in the technology described above. It is a further object of the present invention to provide an automatic film processor which can be used by low skilled worker and which can be operated in precisely the same fashion time and time again. Advantages of such equipment would include being relatively inexpensive to purchase and use and would also include the ability to recycle processing chemistry.

SUMMARY OF THE INVENTION

The present invention provides a photo processor for developing film which includes a trough for holding film processing fluids, a system for injecting fluid into and draining fluid from the trough, and a controller for controlling the operation of the fluid injection and drainage system. A porous container is provided for holding the film during processing operations, the container having a first drive shaft extending through it. A turbulence-generating apparatus, sometimes in the form of an auger, disposed within the container and rotatable with respect to the container in the film is disposed therein. The turbulence generating apparatus is mounted to the drive shaft for rotation with it.

Another aspect of the invention is a processor for developing film having a chassis with a trough for holding developing chemistry, a porous, elongated, rotatable container for holding the film to be developed within the trough, and a drive shaft extending through the container. An actuable support is provided for supporting the drive shaft adjacent each end thereof, and a system is provided for actuating and thereby shifting the support between two positions which causes the drive shaft and the container to be vertically shifted between two positions.

Yet another aspect of the invention is a process for developing film which includes the following steps: positioning the film to be developed in an elongated, porous container; positioning the container over an elongated trough; injecting fluid developing chemistry into the elongated trough; as chemistry is being injected into the trough, dropping the container into the trough; immediately initiating rotation of the container; and after a predetermined period of time, draining chemistry from the trough. As the chemistry is draining from the trough, an additional step of raising the container out of the trough may be included.

DETAILED DESCRIPTION OF THE PREFERRED EMBODIMENTS

Figure 1:
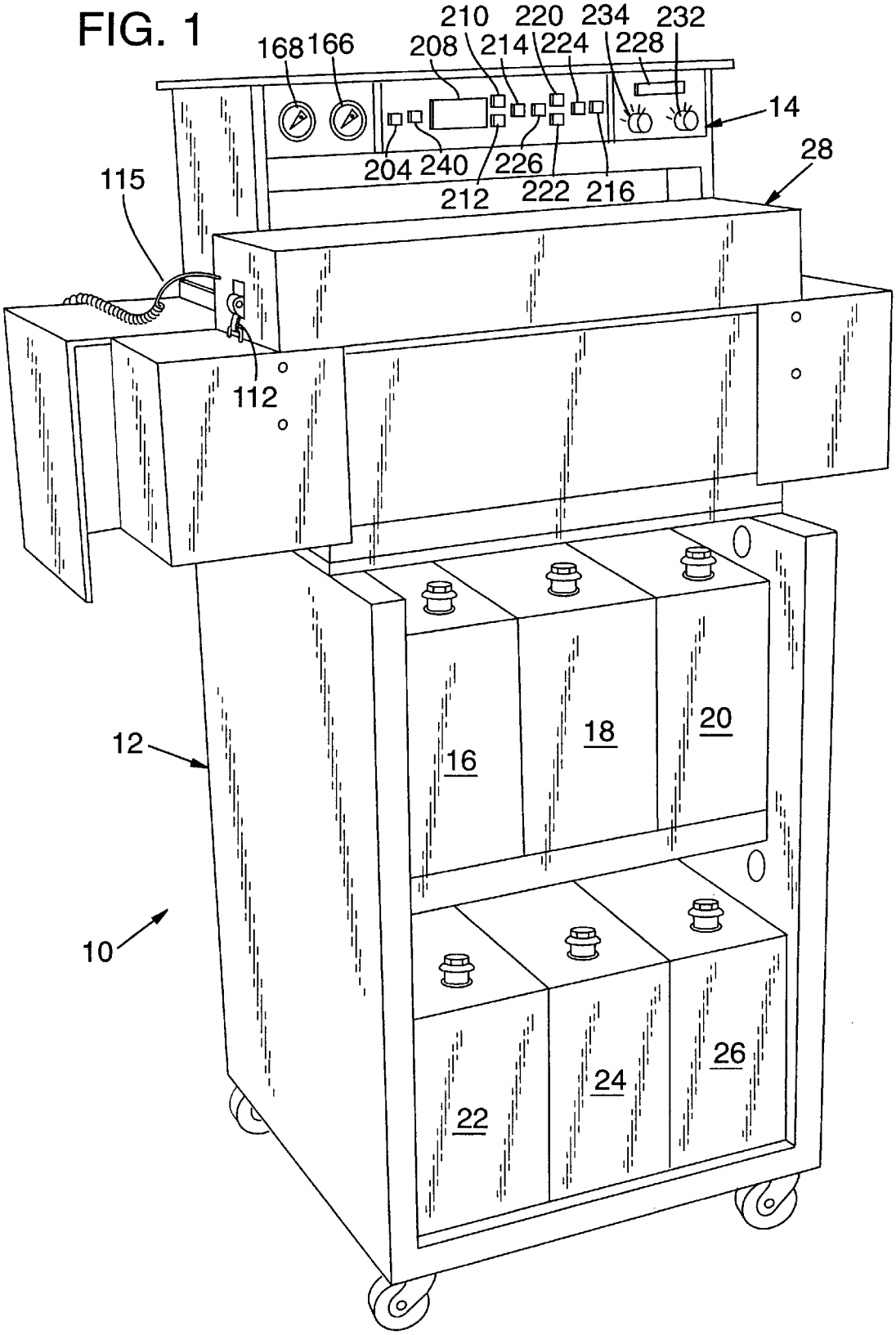
FIG. 1 is a perspective view of a first embodiment of the present invention.
Figure 2:
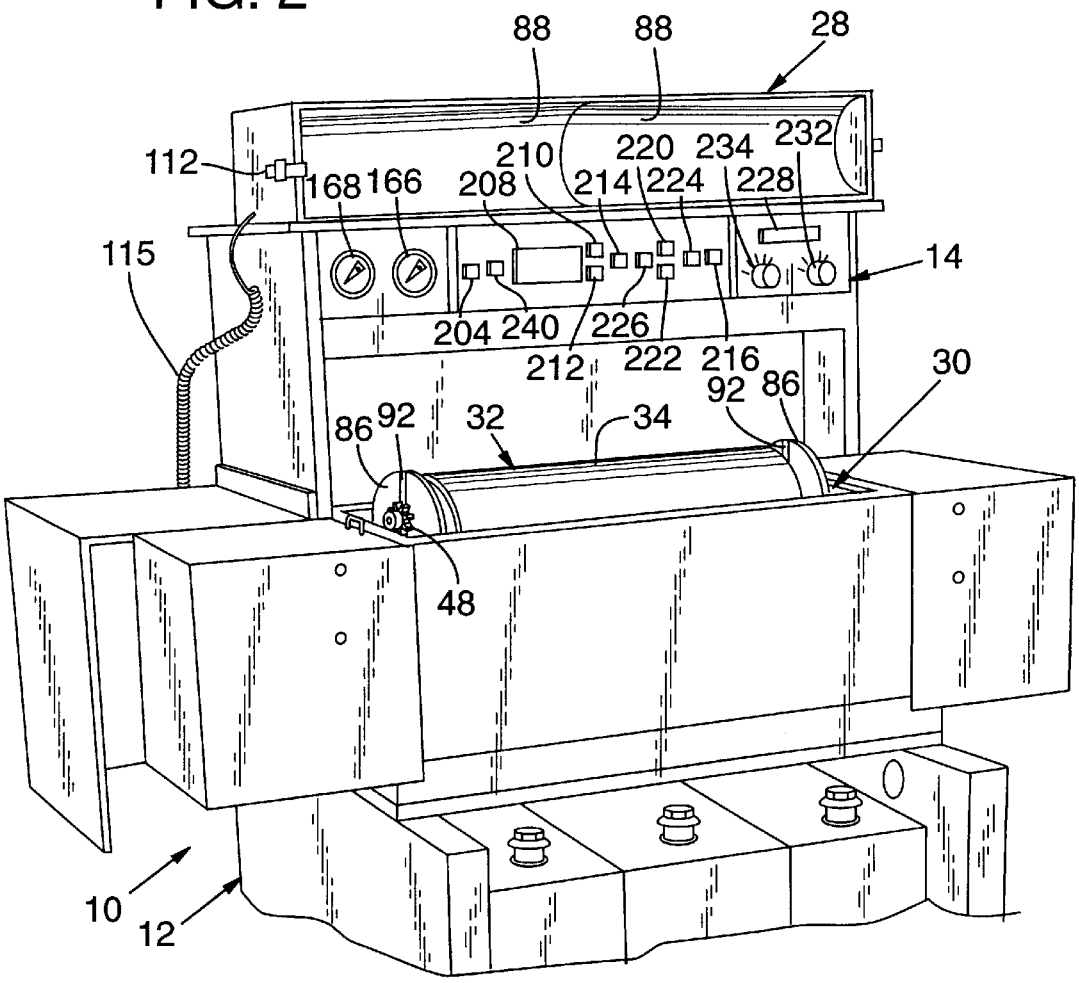
FIG. 2 is a view corresponding to that of FIG. 1, except that it is fragmentary, and the trough area is uncovered.

Referring now to the drawings, and more particularly to FIGS. 1 and 2, shown generally at 10 is a film developing apparatus which includes a cabinet 12, a control console 14, and an array of tanks or liquid supply cells 16, 18, 20, 22, 24 and 26. FIG. 2 depicts the apparatus 10 with a top portion of the removable cover 28 being removed and placed on top of the control console 14. The cabinet 12 acts as a base for a developing trough 30 which is designed to receive wash water and film processing chemistry from cells 16, 18, 20, 22, 24 and 26. Disposed within trough 30 is a removable container 32 which is designed to hold the film to be developed.

The cooperation and coordination of several components facilitate the uniform application of chemistry to the film. In the preferred embodiment, the key to uniform application of chemistry to the film is (1) the rapid application of the chemistry to the film, (2) the rapid and uniform agitation and washing of the chemistry over the film, and (3) the rapid removal of the chemistry from the film.

In this preferred embodiment, the rapid application of chemistry to the film is accomplished by quickly filling trough 30 with chemistry and the rapidly lowering removable film container 32 into the filling trough. Likewise, the rapid removal of the film from chemistry is accomplished to quickly draining chemistry from the trough and rapidly raising the film container from the emptying trough. Furthermore, in the preferred embodiment, the chemistry is rapidly and uniformly washed over the film by a counter-rotating container and auger combination.

Figure 3:
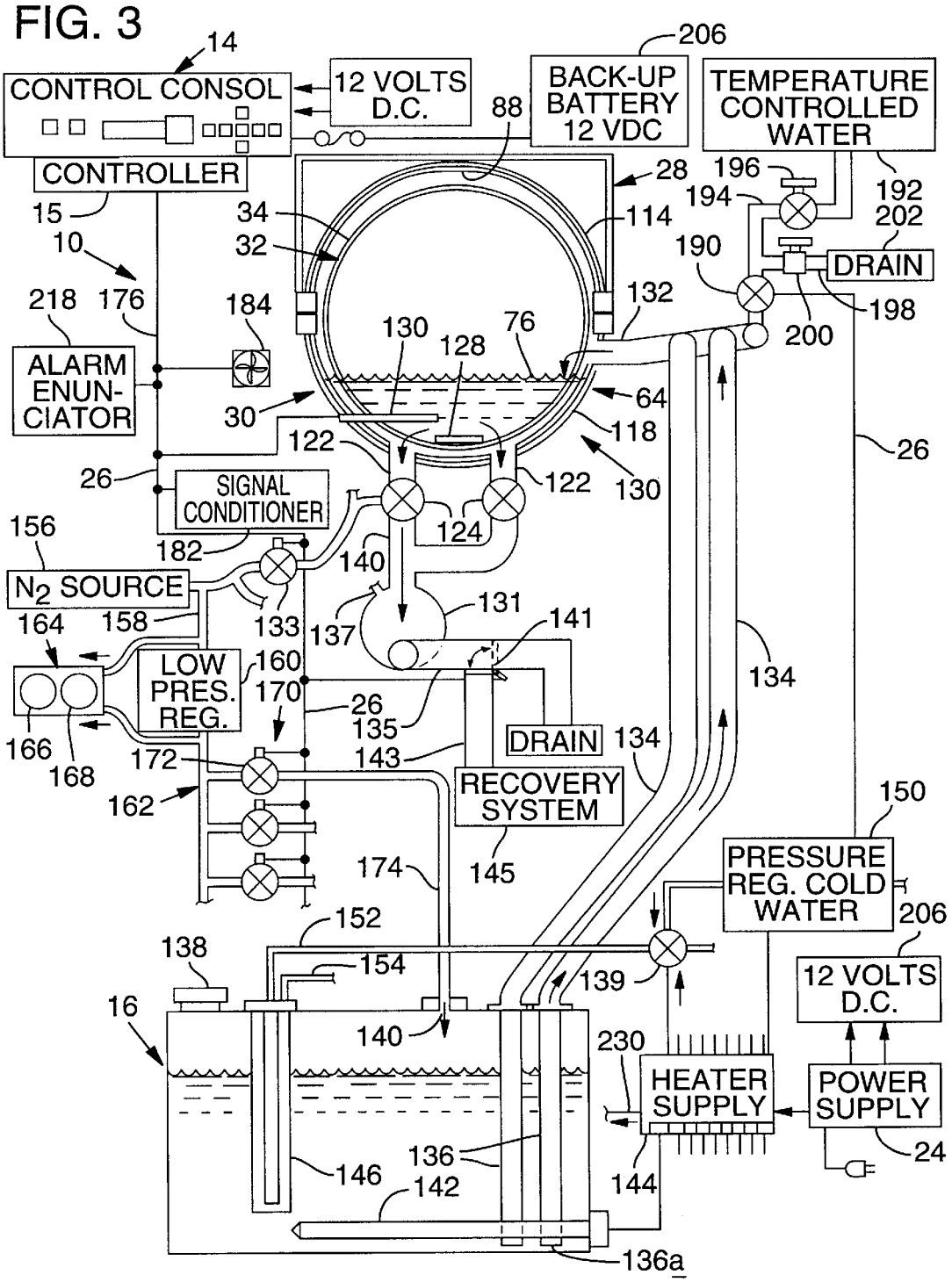
FIG. 3 is a schematic view depicting the embodiment of FIG. 1.
Figure 7:
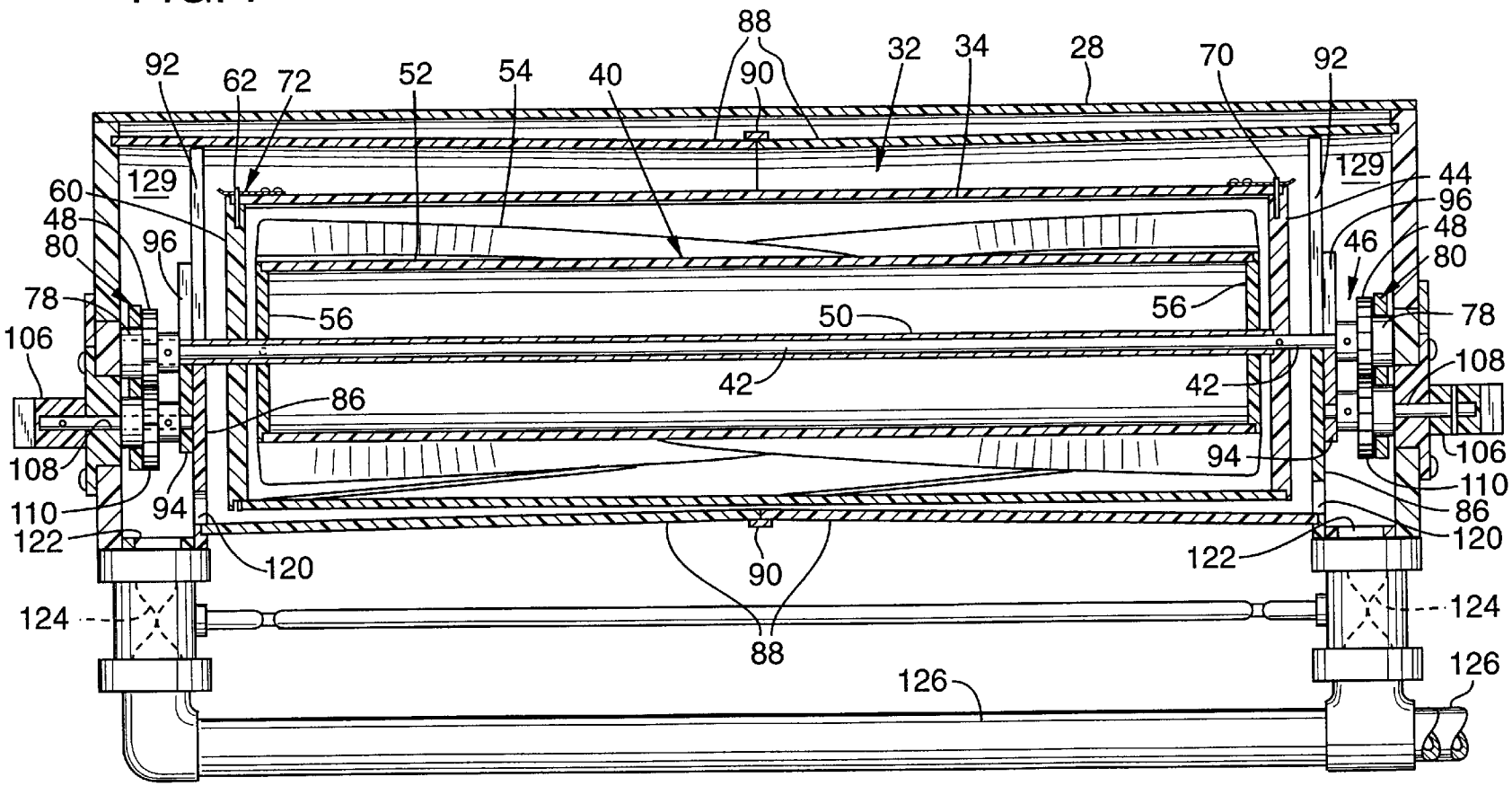
FIG. 7 is a front elevation sectional view taken along line 7—7 of FIG. 2.
Figure 8:
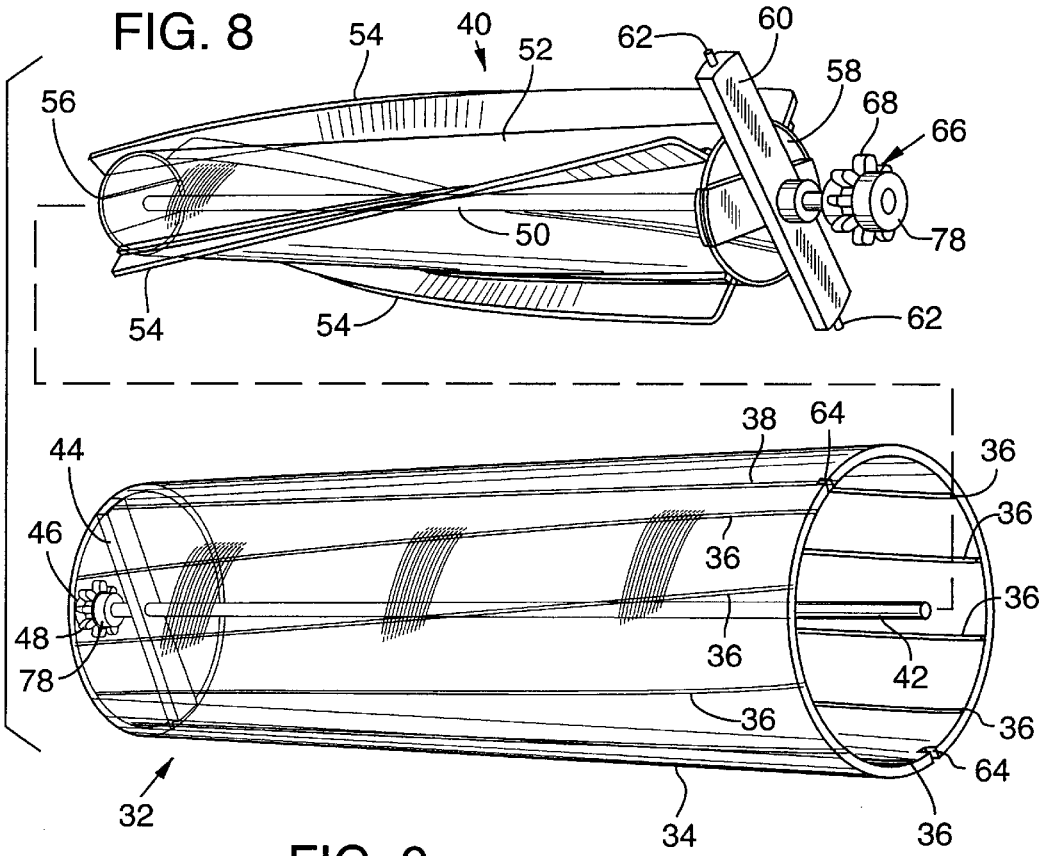
FIG. 8 is an exploded view of the film container, showing the vane structure removed.

The film container is best shown in FIGS. 7 and 8 and is shown schematically in FIG. 3. It will now be described in detail.

Referring now to FIG. 8, container 32 includes an outer, cylindrical shell 34. The shell has a plurality of evenly spaced, slightly twisted or rifled, minute ribs 36 extending from end to end along the inner surface of cylindrical shell 34. These ribs are provided in order to support the film to be processed, as will be explained below. Also included is a pair of straight or axially extending ribs 38, also in the inner surface of cylindrical shell 34. These ribs 38 are designed to assist in assembly of the auger assembly 40 and to facilitate placement of film within the cylinder, as will be described below.

Mounted to cylindrical shell 34 is the centrally disposed, axially extending drive shaft 42, which is positioned in the cylindrical shell by a drive shaft mounting bar 44 which is affixed to one end of the cylindrical shell. Drive shaft 42 is affixed to mounting bar 44 at the point it passes through the bar, so that rotational movement is conveyed from the drive shaft to the cylindrical shell via the mounting bar. The end of drive shaft 42 which is adjacent mounting bar 44 terminates in a drive gear 46 having a plurality of evenly spaced, rounded gear teeth 48.

An auger assembly 40 is best shown in FIG. 8. It includes an auger drive shaft 50 which extends centrally and axially through an auger which is comprised of a cylindrical sleeve 52 having a plurality of rifled or slightly twisted vanes 54 evenly mounted around the periphery of the cylindrical sleeve. Also included is a pair of end caps 56 and 58 which prevent the entrance of water or chemistry into the sleeve, thereby reducing the amount of water and chemistry which needs to be provided during the development process. Auger drive shaft 50 terminates at and is mounted to end cap 56 so that rotational movement is transferred from the shaft to cylindrical sleeve 50 and vanes 54 via end cap 56. Auger drive shaft 50 is rotationally mounted to an auger drive shaft mounting bar 60 which terminates in a pair of end posts 62. These end posts 62 are sized and positioned such that they fit into a pair of radially opposed notches 64 in one end of cylindrical shell 34 which thereby rotationally fixes auger drive shaft mounting bar 60 with respect to the cylindrical shell. Auger drive shaft 50 terminates in a drive gear 66 having a plurality of evenly spaced, rounded gear teeth 68.

Auger drive shaft 50 is hollow, and is designed to receive drive shaft 42 in a co-axial relationship. Relative rotation is permitted between the two shafts, so that a rotational drive imparted to cylindrical shell 34 via drive gear 46 and mounting bar 44 would be permitted while a different rotational speed and/or direction may be provided through auger cylindrical sleeve 52 with vanes 54 mounted thereto by auger drive gear 66 via auger drive shaft 50 and end cap 56. The co-axial arrangement of these two drive shafts 42 and 50 can be seen in FIG. 7, as can the co-axial mounting of auger assembly 40 and cylindrical shell 34. Also shown in FIG. 7, drive shaft mounting bar 44 is typically riveted to cylindrical shell 34 at 70, while auger drive shaft mounting bar 60 is typically removably mounted to cylindrical shell 34 by a mounting clip 72. Thus, with the container 32 removed from trough 30 and the remainder of the apparatus, auger assembly 40 can be removed from cylindrical shell 34 by unclipping one of the mounting bar end posts 62, and then axially pulling the auger assembly out of the cylindrical shell.

Figure 6:
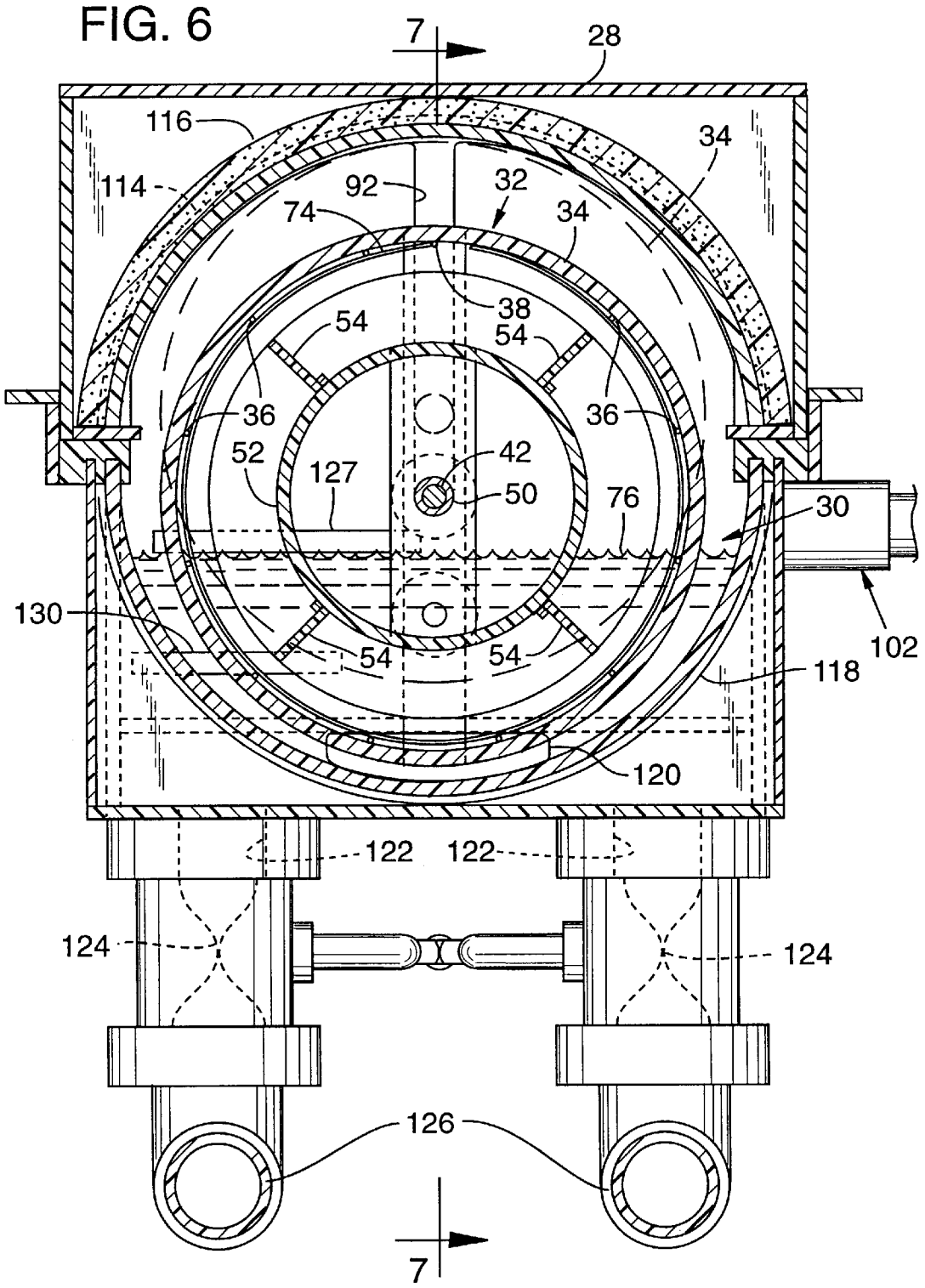
FIG. 6 is a side elevation sectional view taken along line 6—6 of FIG. 2, showing fluid in the trough and the film container in its lowered position.

The size relationship between auger assembly 40 and cylindrical shell 34 can also be seen in FIG. 7, as well as in FIG. 6. In the preferred embodiment, the auger assembly measured between the edges of the vanes, has a diameter of 4.6 inches, while the inner diameter of cylindrical shell 34 is preferably 5.5 inches. Thus, the radially extending vanes 54 can be seen to extend outwardly to a region proximal the inner surface of cylindrical shell 34. This allows for the positioning of the to-be-developed film 74, between auger assembly 40 and cylindrical shell 34. In the preferred embodiment, film 74 is a large sheet having a width approximately equal to the circumference of the container and a height approximately equal to the length of the container. Smaller size formats can be developed using the apparatus, but it is best suited to handle large sheet formats, which have been a problem with existing developing equipment.

Thus, as shown in FIG. 6, film 74 is mounted between auger assembly 40 and cylindrical shell 34 and is supported on ribs 36. By effecting relative movement between the cylindrical shell and the auger assembly, sufficient turbulence is proved within container 32 that laminar flow of chemistry will be virtually eliminated, and film 74 will be subjected to an even application of chemistry 76 provided in trough 30.

The support and drive provided to container 32 is shown best in FIG. 7. As noted earlier, the drive gears are provided adjacent each end of the container, with drive gear 46 being mounted at the end of cylindrical shell drive shaft 42, and drive gear 66 being mounted to auger drive shaft 50. A bushing 78 is disposed outwardly of each of the drives and these bushings are each disposed adjacent a cam 80, shown in section in FIG. 7 and in side elevation in FIG. 4. Each cam includes an inclined surface 82 and an elevated surface 84. Each of the bushings 78 acts as a cam follower which rides up and down inclined surface 82, which causes container 32 to be elevated and lowered for reasons which will become evident as this discussion continues.

Trough 30 is defined at each end by an end plate 86 and by a pair of generally cylindrical but slightly tapered components 88 which are joined at a seam 90. This tapering is usually no more than about 1–3 degrees, but facilitates drainage of the trough to either one direction or the other. Trough end plates 86 each includes a centrally disposed vertical slot 92 in which the drive shafts ride. A wear plate 94 is also provided at each end of the unit affixed to trough end plates 86. A slot 96 is provided in each of the wear plates, and that slot is slightly narrower than the end plate slots 92. Therefore, if any wear is imparted, it will be imparted to replaceable wear plates 94 rather than to trough end plates 86.

Figure 4:
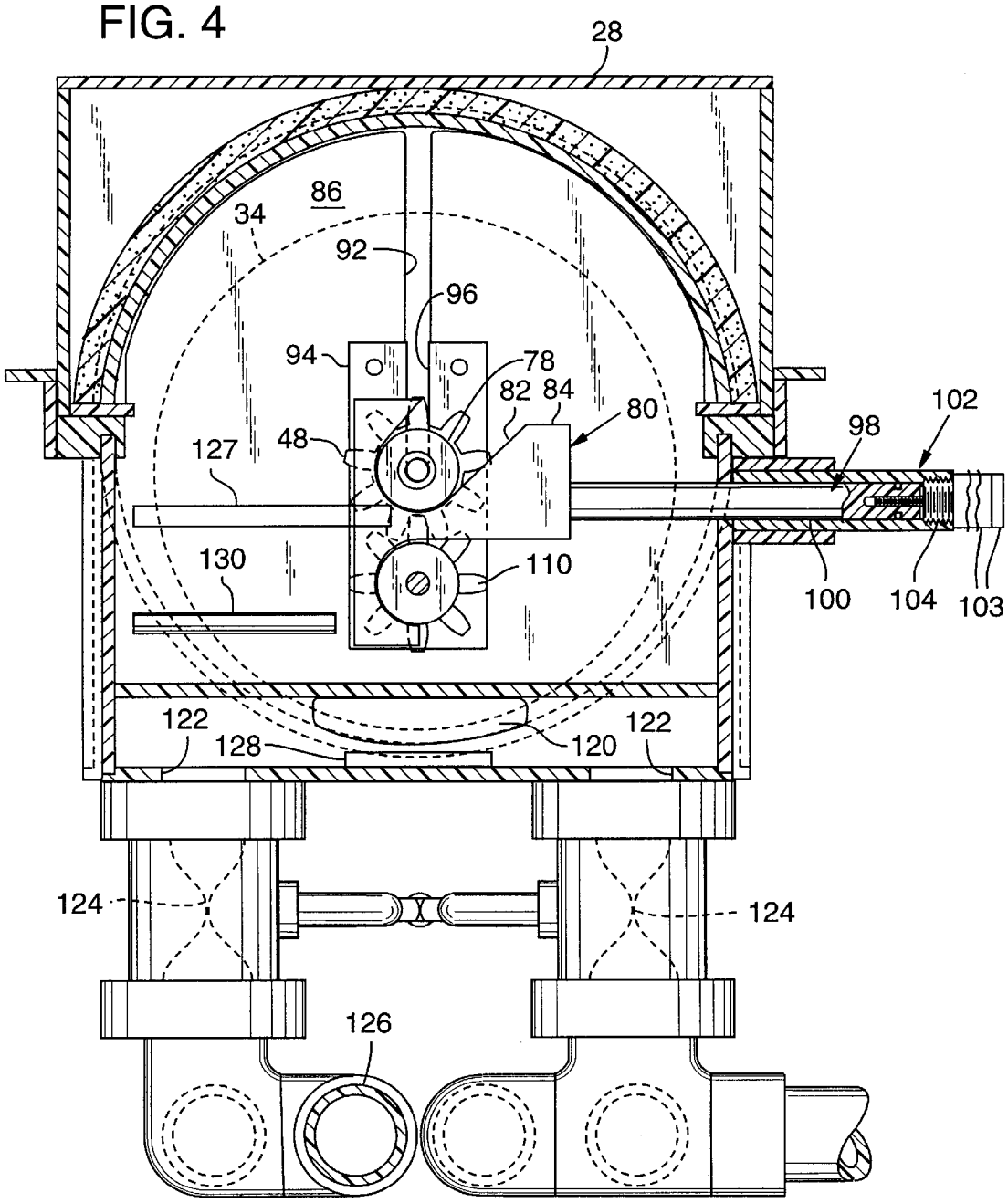
FIG. 4 is a side elevation sectional view taken along line 4—4 of FIG. 2 with the film container shown in its lowered position.
Figure 5:
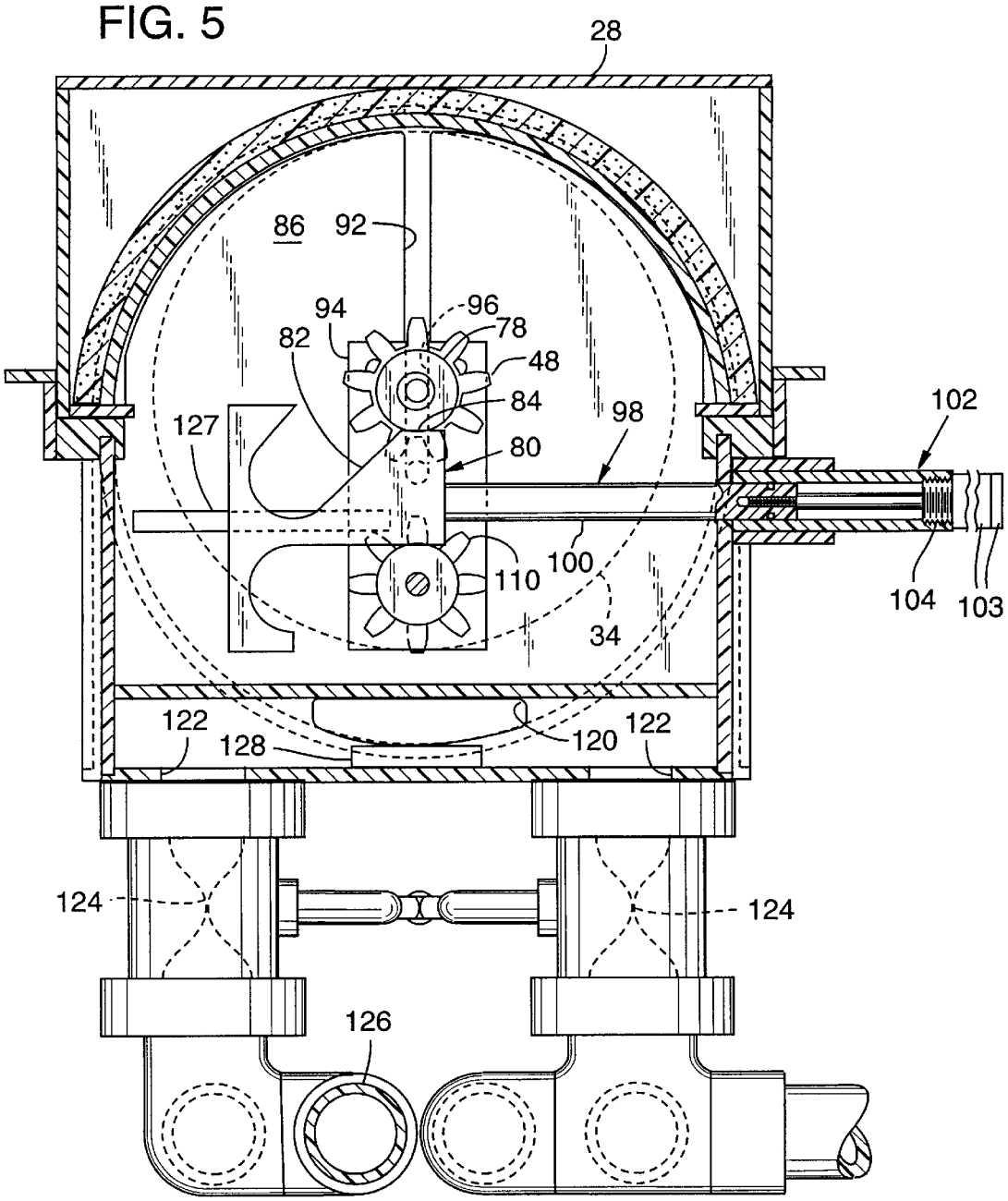
FIG. 5 is view corresponding to that of FIG. 4 except that the film container is shown in its raised position.

The two cams 80 are each actuated by an actuator mechanism 98 which includes an actuator arm 100 and an actuator mechanism 102. In the preferred embodiment, the actuator mechanism is in the form of a pair of air cylinders. The air cylinders are typically double acting Humphrey pneumatic cylinders, in the form of in line ½ inch needle valves, at a pressure of 70 psi, with a travel of 1½ inches, and with a damper mechanism built into it. A set screw 104 is typically provided in order to vary the movement of actuator arm 100. When the actuator arm is in its right-most position as seen in FIG. 4, bushing 78 is positioned at the bottom of inclined surface 82 of cam 80. When the actuator arm 100 is extended to the left as shown in FIG. 5, bushing 78 is shown to have slid upwardly along inclined surface 82 and is disposed on elevated surface 84. Because of slot 96 in wear plate 94 and slot 92 in trough end plate 86, bushing 78 and the drive shafts mounted to it are not permitted to shift to the left, and can only move vertically in slot 92. In order to move the shafts down to their lowered positions shown in FIG. 4, actuator arm 100 is again retracted to the right, and cam 80 slides down inclined surface 82 and is lowered vertically along slots 96 and 92 (see FIGS. 4 and 5). The purpose of this vertical displacement of bushing 78 and the drive shafts mounted to it is to raise and lower container 32 out of and into the water or chemistry 76 found within trough 30, as will be explained in more detail below.

In order to provide rotational power to drive shafts 42 and 50, a pair of motors 106 are mounted to motor shafts 108 and motor gears 110 which mesh with teeth 48 of the shaft drive gears, as shown in FIG. 7. As seen in FIGS. 4 and 5, cam 80 is constructed so that as actuator arm 100 moves to the right and to the left, the position of motor gears 110 remains unchanged. In the preferred embodiment, motors 106 are permanent magnet DC gear motors, and provide a rotation speed of approximately 30 rpms for both the container and the auger.

As shown best in FIG. 6, the removable cover 28 fits over trough 30 during the developing process. It is typically fastened in place by a pair of spring clamps 112, one of which shows in FIG. 1. As shown in FIG. 2, cover 28 includes the upper half of substantially cylindrical but slightly tapered components 88. The tapered components are preferably tapered ¼ inch per foot. A resistive heating coil 114 is also disposed in cover 28, and is surrounded with insulation in the form of ¼ inch thick closed cell foam as seen in FIG. 6. This coil is provided with electricity through a coiled cord 115, shown in FIGS. 1 and 2. The bottom half of substantial cylindrical but tapered components 88 is also backed with a resistive heating coil 118, although insulation is typically not included around that heating coil. The heating coils are provided in order to elevate the temperature of the air in the trough when it is empty, and to maintain or elevate the temperature during processing. This provides for an air incubation capability for the various components and perhaps even film in particular instances, as will be explained below, and provides greater control and accuracy for the developing process.

To facilitate drainage from trough 30, a pair of drainage ports 120 are provided to drain water and chemistry from the trough. As shown in side elevation in FIGS. 4–6, and in cross-section in 7, the ports are provided in the lower portion of each of the trough end plates 86. As seen best in FIG. 7, water or chemistry which leaves trough 30 is directed to one of four downspouts 122, two of each of which are disposed at each end of the trough, as shown best in FIGS. 4–7. Each downspout has a shut-off valve 124, which is typically in the form of a pneumatic valve, such as the Airpinch valve provided by Richway Industries of Janesville, Iowa. Each of the four shut-off valves is provided with its own drainage line 126, so that swift drainage is ensured from each of the downspouts 122.

As shown in FIGS. 4 and 5, each of the trough end plates 86 includes an enlarged, elongated opening 127 which acts as a weir to permit any excess water or chemistry above the level of the lower edge of the weir opening to flow out of the trough and down through downspouts 122. A normal operation of apparatus 10, the level of water or chemistry will be somewhat lower than the lower edge of weir opening 127, although it is possible in some applications that the level might be precisely at that edge. During wash water processing steps, water is continuously pumped into the trough and over and into weir openings 127. In this manner a continuous and effective wash cycle is ensured.

As shown in FIG. 3, a level sensor 128 is provided to sense the level of water or chemistry in trough 30. The level sensor is normally in the form of a pressure transducer, which has been schematically represented in the depicted embodiment in the bottom of the trough, as shown in FIGS. 4 and 5. A pair of air column openings (not shown) are disposed just below the bottom of the trough (one at each end of the trough), the air columns being connected pneumatically with a "Y" fitting. A single tube then extends to the control console, where the pressure transducer (not shown) is disposed. This embodiment has not been depicted in order to simplify the drawings. In order to determine the level with precision, specific gravity values for the chemistries in each of the cells is stored in the controller to provide a proper solution depth regardless of the specific gravity of the solution. In the preferred embodiment, specific gravity values may be adjusted in 0.05 increments between 1.00 and 1.40.

As will be explained below, the reading of the level sensor is fed to the controller, which can either provide more or less fluid into the trough. A temperature sensor 130 determines the temperature of the water or chemistry and similarly has this reading fed into the controller.

Reference should now be made to FIG. 3 which schematically depicts many of the control aspects of apparatus 10, as well as many of the components which do not appear well in the other figures. Trough 30 is shown with its top cover 28, but for purposes of simplification, container 32 with auger assembly 40 therein has been deleted. The wash water or chemistry 76 is shown in the trough, and is supplied via a feed line 132 which introduces water or chemistry into the central portion of the back of trough 30. The system disclosed in U.S. Pat. No. 5,023,643 similarly includes a feed line located intermediate the ends of the trough, adjacent the center thereof, so that processing water and chemistry be rapidly and uniformly introduced into the trough, and a central feed line is included in the present embodiment for the same purpose.

A pair of upright conduits 134 leads from each of the liquid supply cells 16, 18, 20, 22, 24 and 26 via a pair of draw tubes 136 having openings 136*a* at their ends disposed within one of the liquid supply cells. For purposes of this figure, only one of the liquid supply cells, 16, has been depicted, but the system is essentially the same for each of the cells.

As indicated previously, each of the liquid supply cells 16, 18, 20, 22, 24, and 26 holds solution for carrying out a particular type of process. For example, they might include developer, bleach and fixer for a color film processing regimen such as that known as C-41. Solution for carrying out an E-6 process for developing color reversal film, may also be provided, as may different types of black and white developer and fixing solution. Either additional or fewer cells could be provided, depending upon the variety of processes which need to be implemented using the apparatus 10.

Each of the liquid supply cells, such as 16 in FIG. 3, is similarly constructed, with each cell having a gas-tight wall surrounding it. Each cell includes a gas-tight cap 138 and a gas inlet port 140 disposed in the top wall of the cell for allowing the entry of pressurized gas into the cell.

In the depicted embodiment, a storage cell temperature system includes a combined temperature sensor/heater probe 142 to sense and heat the processing solution contained in the cell. The probe is connected to a heater control 144 which monitors the temperature of the solution in each storage cell, and if a temperature that is too low is detected, heater control 144 applies power to probe 142, thereby heating the probe and raising the temperature of the solution in the cell. In the preferred embodiment of probe 142, a linear temperature sensor is located at the tip thereof, while resistance heating wires are located along its length.

A coaxial heat exchanger 146 may also be provided in each tank and, should heater control 144 which serves as a separate control mechanism for the storage tank temperature system, detect a solution temperature which is too warm, a valve 139 is opened, allowing cool water from a pressure regulated cold water supply 150 to flow through a line 152 to coaxial heat exchanger 146, thereby cooling the solution of the tank. Water leaves coaxial heat exchanger 146 through a disposal line 154, which may proceed directly to a drain, or may be connected in series to other coaxial heat exchangers for the other cells.

In the depicted embodiment, water or chemistry is forced from the liquid supply cells by pressurized gas which enters the cells via port 140. Because cap 138 renders the cell gas-tight, injection of pressurized gas will cause water or chemistry to flow up through upright conduits 134 into the trough via feed line 132. This pressure is provided from an inert gas supply, such as a nitrogen source 156. Nitrogen source 156 is connected to a high pressure conduit system 158, a low pressure regulator 160, and a low pressure conduit system 162. A pair of gauges 164 is located in control console 14 and include a high pressure gauge 166 and a low pressure gauge 168.

It is actually preferable to use two separate low pressure regulators, to provide greater control of chemistries. The use of two separate low pressure regulators enables accommodation of the fact that the chemistry cells 16, 18, 20, 22, 24 and 26 are disposed at two different levels. The use of two separate low pressure regulators is advantageous both as a result of the difference in pressure head between the two cell levels, and due to the fact that the conduits extending from cells 16, 18 and 20 are of different length than the conduits extending from cells 22, 24 and 26.

An array 170 of pneumatic valves is connected to low pressure conduit system 162. Each valve in the array, such as a valve 172, is connected by a conduit 174 to cell 16 via gas inlet port 140. Upon an appropriate signal received over controller bus 176, valve 172 opens, allowing nitrogen to enter cell 16, thereby forcing solution from the cell through draw tubes 136, upright conduits 134 into feed line 132 and then into trough 30. Processing solutions are pumped from the storage tanks to the trough at the rate of approximately four gallons per minute, with a maximum pumped volume of 128 ounces. The pressure transducer senses the level of chemistry in the trough and controls the time that valve 172 is open. The length of time that valve 172 is open determines the amount of solution that will be pumped from the storage cell to the processing trough. An added advantage of pumping processing solutions with an inert gas, is that the inert gas will retard oxidation of the processing solution contained in the cells. Nitrogen is the preferred inert gas due to its abundant supply and ready availability. In the course of filling the cells, the cells are filled to a maximum fill line and the air in the tank is purged by the operator and then replaced with nitrogen. The residual gas is thus inert which prolongs the working life of the chemistries as noted above.

As previously described, heating coils 114, 118 on the top and bottom portions of trough 30 are designed to maintain or elevate the temperature in the trough when the trough is empty in order to heat up the parts and to provide an air incubation capability. In many instances it may be desirable to have the film which is being developed maintained in an environment with a temperature elevated above ambient. Heating coils, and particularly lower heating coil 118, will also have an effect upon the temperature of the wash water and chemistry which is pumped into trough 30. Combined trough temperature sensor and heater 130 is provided both to detect the temperature in the trough, and, in conjunction with coils 114 and 188, to elevate that temperature if desired. Sensor/heater 130 provides an input to the controller 14 which is used to maintain the trough at the proper processing temperature. Temperature sensor/heater 130 and controller bus 176 linearize the temperature signal prior to the signal reaching the controller mounted within control console 14. The controller has been schematically indicated at 15 in FIG. 3.

A trough cooling mechanism may also be provided, and in the preferred embodiment takes the form of a fan 184 activated should the temperature of the trough or the wash water or chemistry therein, rise above a preselected temperature. The fan is operable to move air over the outer wall of the trough, thereby cooling the temperature of the liquid in the trough. Fan 184 is an exhaust fan which draws air from inside cabinet 12 over trough 30. Fan 184 and heating coils 114 and 118 and heating aspect of sensor/heater 130 operate alternatively such that the heating coils and heater are turned off, fan 184 will normally be turned on, and vice versa. The fan and heating coils/heater are operable to change the temperature of a fall trough, generally having about 128 ounces of liquid therein, by ½° F. in sixty seconds.

In an application where only color film is being processed, it is entirely possible that a cooling system such as that depicted would not be needed because color development typically involves higher temperatures. Fan 184 has been included in the depicted embodiment, however, in order to provide a unit with substantial versatility.

Controller 15 within the control console 14 collectively operates the heating and cooling mechanisms to maintain the liquid in the trough at preselected temperature. The preselected temperature is determined by the specifications for processing the particular photographic material in the processor. The controller also adjusts the processing step times as desired by the particular process, and as controlled by the operator using the control console switches.

As noted previously, trough liquid level sensor 128 and its pressure transducer detects the level of liquid in the trough. The level sensor is used to control the amount of time that a valve in valve array 170 remains open. As will discussed later, the level and hence the quantity of fluid in the trough may be varied by an appropriate input into control console 14.

Each processing step terminates with a DUMP STEP, prior to beginning a processing cycle. The level sensor 128 controls the entry of wash water into trough 30 in certain wash cycles. For any given wash cycle, an appropriate signal is transmitted over a controller bus 176 to a wash water solenoid valve 190. Valve 190, when opened, allows temperature controlled water from a temperature controlled water source 192 to enter feedline 132 from where it flows into trough 30.

Water source 192 is connected to a wash water conduit 194 through a needle valve 196, which is operable to control the flow rate of water into the apparatus. Because the water temperature is critical during the processing cycle, the temperature controlled water must remain flowing in order to provide water of the desired temperature as close as possible to the liquid-entry feed line 132. To accomplish this, wash water conduit 194 is connected to an outflow conduit 198 which has a bypass flow restrictor 200 located therein. Water going through flow restrictor 200 eventually goes to drain 202. In the preferred embodiment, bypass flow restrictor 200 is generally set at one-fourth of a gallon per minute.

The drains lead from the trough into an exhaust manifold 131 as shown in FIG. 3. A single pneumatic valve 133 is connected to high pressure conduit system 156 and then to pneumatic shut off valves 124 in downspouts 122. Upon an appropriate signal received over controller bus 176, valve 172 opens, thereby causing shut off valves 124 to open rapidly draining liquid from trough 30 into exhaust manifold 131.

Because the entry of fluid into exhaust manifold 131 is quite rapid, the manifold is sized to be capable of containing the largest amount of fluid which would be expected in trough 30 at any one time.

Various means for evacuating wash water and/or chemistry from trough 30 will be discussed. The first drain mechanism is an overflow system which includes weir opening 127 which, as shown in FIG. 4, is disposed along end plate 86 to act as a weir to permit any excess water or chemistry above the level of the lower edge of the weir opening to flow out of the trough and down through downspouts. When water or chemistry overflows into weir openings 127, it passes directly down through end regions 129 and through drainage ports 120 into downspouts 122. Whether fluid is passing out of weir openings 127 or through drainage ports 120, it passes through downspouts 122 and drainage line 126 and into exhaust manifold 131.

A drain conduit 135 is connected to one end of exhaust manifold 131 for carrying away used fluids. An air vent 137 is provided in exhaust manifold 131 to facilitate smooth drainage from the exhaust manifold. Drain conduit 135 extends from exhaust manifold 131 to a drain or disposal system 143 and/or to a recovery system 145 via a recovery system valve 141. Under most circumstances, valve 141 is closed, allowing fluid contained in the exhaust manifold to enter drain 143. In the case of some solutions, such as the bleaching solution used in color processing and the fixing solutions used in both color and black and white processing, it is desirable to recover these solutions for reuse or for further processing. Recovery system 145 is provided to retain solutions for further use or processing. As such solutions are drained from the trough, valve 141 is open. Additional valves (not shown) may be provided to direct the solution to any one of a number of recovery tanks which will hold used solution. Valves 141 may be operated either electrically or pneumatically. Signals from controller 15 are used to properly sequence control signals to the valve.

Operation

Before operating apparatus 10, it is connected to a 110 volt AC power supply, a nitrogen source, temperature controlled and pressure regulated water supplies, and a fluid drain. When the apparatus is connected to a power source, the heaters in the solution storage cells operate continuously, as does a charger for a back-up battery, shown at 206.

To begin a processing cycle, the operator turns the system on with a power switch 238 on control console 14. In the event of a power failure, back-up battery 206 provides power to all circuits except the storage tank and trough heaters. There is sufficient power stored in the back-up battery to complete any normal processing cycle, once the cycle has begun. A display 208 is provided to indicate processing status to the operator. In the preferred embodiment, display 208 is a four line by twenty character LCD display. In addition to various messages and programming information, the display also provides a graphic indication of set and actual trough liquid level. Entry keys 210 and 212 allow the operator to adjust the fill level of solution up and down, respectively. The appropriate level for processing film in a variety of different development processes is provided in a chart in the processor operating manual. Other keys are also provided in the main portion of control console 14. The first of these is a MODE key 214. This key allows the operator to select a particular mode of operation. Such modes are RUN, DIAGNOSTIC and EDIT. When the processor is in the RUN mode and a process cycle is underway, the MODE key may be used to view times for the various steps in the selective processing cycle while the process is running. At POWER UP, the processor is defaulted to a RUN mode. If the MODE is depressed during POWER UP, the specific gravity values for each storage tank may be changed, if required.

A START/ENTER key 216 is provided and is operable to start processing when the unit is in the RUN mode and is used as an ENTER key when the processor DIAGNOSTIC or EDIT mode. The START/ENTER is also operable to silence an audible alarm enunciator 218 at any time the alarm sounds. The four keys remaining on control console 14 serve as cursor keys, with keys 220 and 222 providing UP and DOWN cursor movements, respectively, while keys 224 and 226 serve as LEFT and RIGHT cursor keys, respectively. LEFT cursor key 224 also provides a STEP function which, when a processing cycle is running, forces the processor to evacuate the contents of trough 30 and proceed to the next processing step. RIGHT cursor key 226 functions as a HOLD key, which forces the process or to hold the current solution in the processing trough until the key is pressed a second time at which point normal processing resumes.

Also included in control console 14 is a storage tank temperature indicator 228 which is coupled directly to heater control 144 over a line 230, and displays the temperature of solution in a selected storage cell. Rotary switches 232 and 234 allow the selection of a particular cell temperature to be displayed. Heater control 144 is also connected to controller bus 176 to provide a status input to controller 15. If the system is instructed to begin a processing run when the temperatures of the solutions in the cells are outside a predetermined range, alarm enunciator 218 will be activated. This may be overridden and processing begun with temperatures outside acceptable ranges, however, the trough heating/cooling mechanism will be activated in a near-continuous manner, and the desired uniformity of film density may not be achieved.

Figure 12:
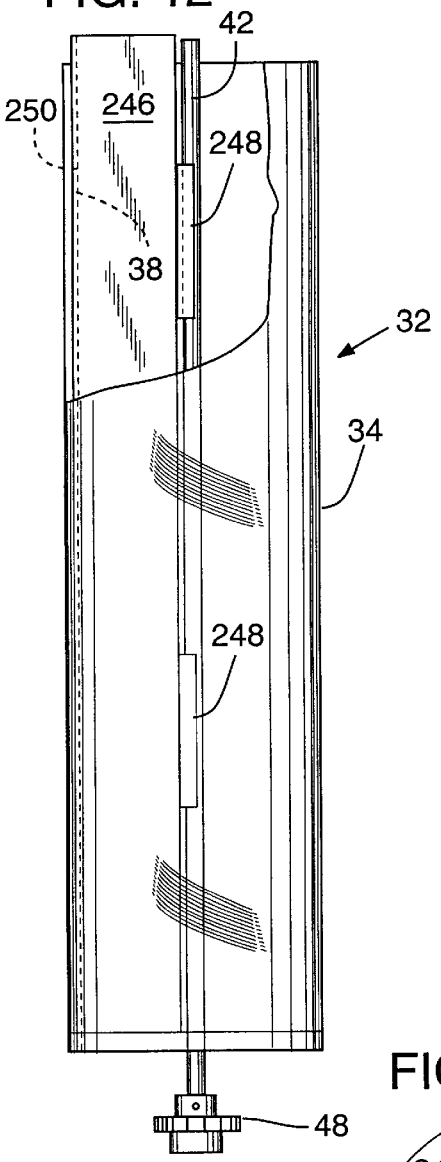
FIG. 12 is a side elevation view of a film positioning guide.
Figure 13:
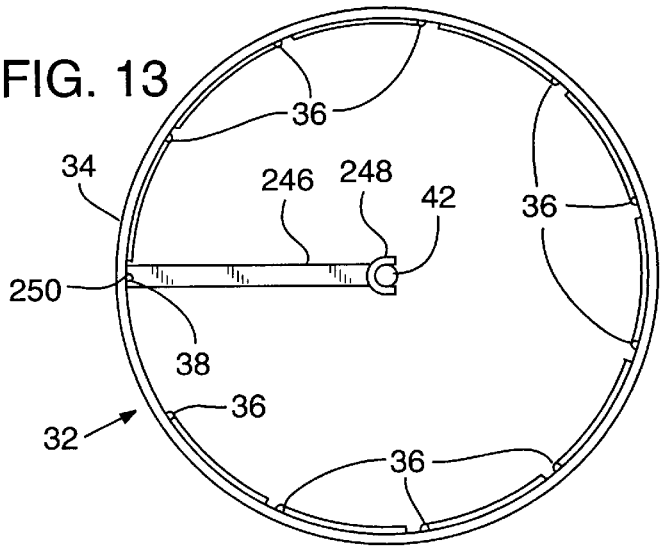
FIG. 13 is a top plan view of the container with the guide inserted therein.
Figure 14:
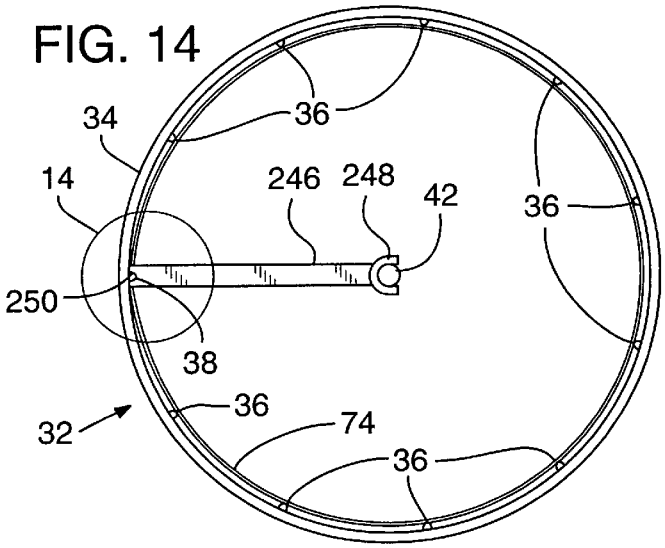
FIG. 14 is a view corresponding to that of FIG. 13, except that it includes film in the container.
Figure 15:
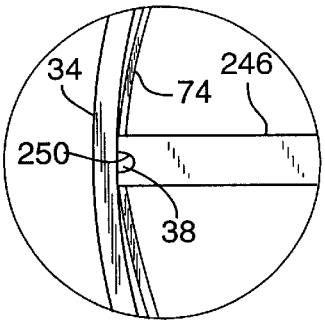
FIG. 15 is an enlarged fragmentary view of the engagement of circled area 15 in FIG. 14.
Figure 16:
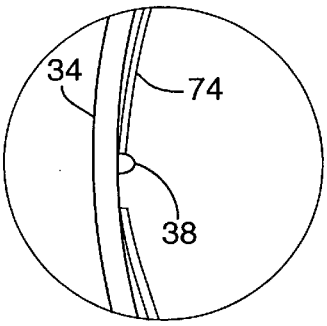
FIG. 16 is an enlarged fragmentary view of the engagement of circled area 15 in FIG. 14, expect that the film is shown in place in the container.

Before activating the system for film processing, the film to be developed is first placed into the film container 32. A guide or template has been developed to facilitate proper positioning of the film within the container. This template and positioning process is depicted in FIGS. 12–16. The guide 246 is designed to slide down into cylindrical shell 34, with a pair of engagements 248 designed to fit partially around drive shaft 42. At the edge of guide 246 which is opposite engagements 248, is a narrow groove 250 which is designed to receive one of the two longitudinal ribs 38 in container 32, as best shown in FIG. 15. Thus, it can be seen that guide 246 is slid down into container 32, with engagements 248 engaging shaft 42, and with groove 250 receiving rib 38. Once guide 246 is in place as shown in FIGS. 12–14, the film 74 is slid down into the container to the position shown in FIG. 14. FIG. 16 shows the film 74 in abutment with rib 38. Guide 246 is then removed, and auger assembly 40 is slid down into container 32 with auger drive shaft 50 sliding over drive shaft 42. The relative positioning of auger assembly 40, container 32 and film 74 is shown best in FIG. 6. Once film 74 is slid into the container and the auger assembly is in place, mounting clip 72 in mounting bar 60 engages end posts 62, thereby positively positioning the auger assembly.

To position container 32 in trough 30, the top portion of cover 28 is removed, and the container moved into position with drive shaft 42 and auger drive shaft 50 sliding through slots 92 in trough end plates 86. Because the diameter of drive shaft 42 is smaller than the diameter of auger drive shaft 50 (see FIG. 7), and their slots 92 are of corresponding dimensions, the container fits into position in a single orientation. That is, it cannot be improperly reversed, end-to-end, which might result in batch-to-batch differences in the processing operation. The teeth of drive gear 46 and drive gear 66 are engaged with the teeth of motor gears 110 as best shown in FIG. 7. With container 32 thus positioned, the top portion of cover 28 is mounted in place. In this raised position, the upper portion of the container is closely adjacent to the cover. Because actuation rod 100 will be in its extended position as shown in FIG. 5, bushings 78 will come to rest on elevated portions 84 of cams 80.

To run the system, the tempered water supply must first be turned on. Next the nitrogen is turned on at its source. The high pressure setting should have a reading of about 60 to 70 psi, while the low pressure setting should have a reading of 2.5 to 3.5 psi. Power switch 204 is then turned on.

Before entering a RUN cycle, gas-tight caps 138 on the solution storage cells 16, 18, 20, 22, 24 and 26 should be checked to ensure that proper pumping of processing solutions will occur. Also, the system should be inspected to see that there are sufficient processing solutions available for the processing cycle and that the water temperatures are properly set. The trough fluid level is now set with level keys 210 and 212. At this point, the control console will display the following entries:

RUN PROCESS
SELECT PROCESS
SET DEVELOPER TIME
PREHEAT

The cursor may now be moved to line 2, SELECT PROCESS and ENTER key 216 is depressed. The next and subsequent screens will display preset processes and custom processes. The appropriate process may be selected and the screen will return to the original menu. If desired, the trough and its contents may be preheated by moving the cursor to the PREHEAT selection and pressing ENTER. This will allow water from the temperature controlled water supply 192 to enter trough 30 through liquid feed line 132. The water level in the trough will rise until it reaches the level of weir openings 127 in trough end plates 86 and thereby into end regions 129, drainage ports 120 and downspouts 122. PREHEAT must then be manually deactivated, again pressing the ENTER key, which causes water to be dumped.

Film is inserted into container 32 and the container is placed into trough 30. The top cover 28 is then placed over the trough. At this point, the room lights may be turned on. A convenience back light is provided on control console 14. The light may be activated by pressing key 240.

A representative process is the C-41 process mentioned earlier. This process will be used as an example of processor operation. With film 74 loaded into container 32, with auger assembly 70 positioned therein, and with the container positioned in trough 30, the cursor is moved to the RUN PROCESS position of the display and the caps ENTER key is depressed.

The standard process cycle for the C-41 process includes the following steps:

A pre-soak in temperature controlled water of 2:00 minutes;

development of 3:20 in developer at a temperature of 100° F.;

bleach for 6:30;

wash (first) for 2:00;

fix for 6:30;

wash (second) for 3:20.

This C41 process is a common one, but for purposes of the present description, the initial pre-soak step has been deleted. In addition to preparing the film for development, the pre-soak step typically heats the trough components to a desired, uniform temperature. In the preferred embodiment, the previously described heating coils can provide this heating function in an "air tempering" process which elevates the temperature of the trough components to a temperature approximately 10° higher than the first developer step, or to 110° F. in the preferred embodiment. The above process may also be varied by the addition of a one minute stop bath between the developer and bleach steps in order to prevent continued dye coupling (some layers of film continue to develop at different rates from other layers) which would occur with some film types. An acetic acid stop bath would normally stop all further development of the different film layers.

Figure 9:
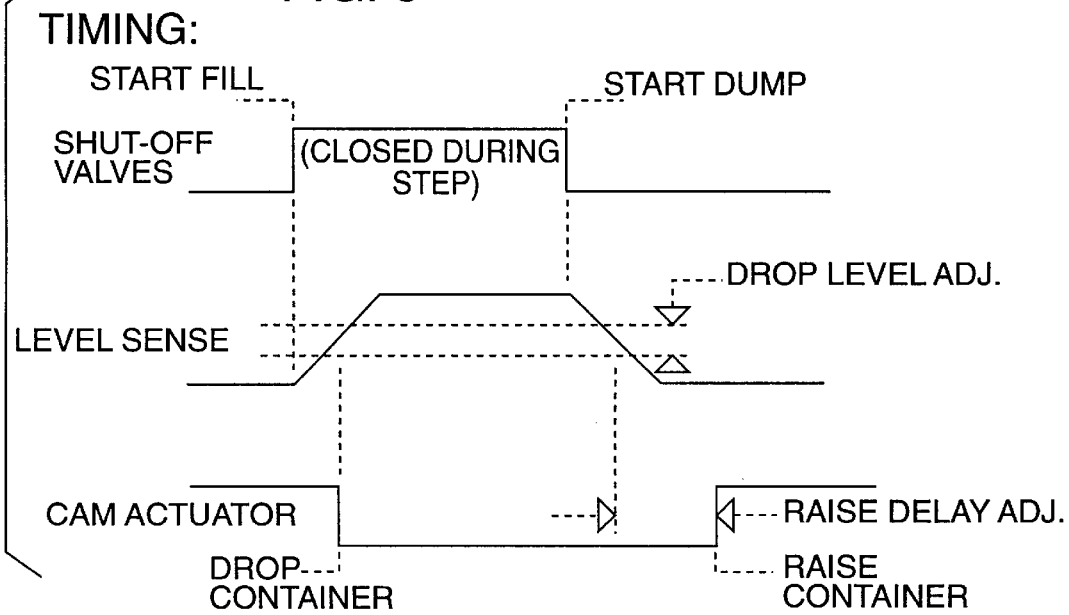
FIG. 9 is a timing diagram showing the timing of the steps of the developing process using the embodiment of FIG. 1.

Reference should now be made to FIG. 9 which schematically illustrates the operation of the shut off valves 124, level sensor 128 and cam actuator mechanism 98. The initial position of cam actuator mechanism 98 is with cam 80 in its extended position so that bushing 78 is resting on the elevated surface 84 of the cam, as depicted in FIG. 5. In order to initiate injection of developer chemistry into trough 30, controller 15 sends a signal via controller bus 176 to one of the valves 172 which controls the flow of low pressure gas through one of the conduits 174 and then to the cell which includes developer. This pressure forces developer up through the conduits 134 and into trough 30 via feed line 132.

Just prior to the time that the rising level of chemistry 76 reaches the lowest portion of film 74, actuator mechanism 98 causes actuator arm 100 to retract, permitting cam follower 78 to drop down the inclined surface 82 of cam 80 so that container 32 drops abruptly into the fluid which is rapidly entering the trough. This lowered position of the container is depicted in FIG. 4. In this lowered position, container drive gear 46 and auger drive gear 68 each engages a motor gear 110, causing both the container and the auger to immediately begin rotating in opposite directions. Approximately every ten seconds during this process, the rotation of motor gears 110 reverses, thus reversing the direction of rotation of both the container and the auger. With both container 32 and auger assembly 40 rotating, the film is uniformly and filly exposed to the turbulence of the developer fluid. This reduces the possibility of any laminar flow which could cause irregularities in the developing process.

Once the level of fluid in the trough reaches a predetermined level as determined by level sensor 128, valve 172 is closed, thereby stopping the pressure actuation which is causing fluid to flow out of the cell and into the trough.

When the time for the first processing step has reached an end, controller 15 sends a signal to simultaneously open all four shut off valves 124, which causes the liquid to quickly drain from the trough, through exhaust manifold 131 and past valve 141 to the drain. As the trough is emptying, once level sensor 128 determines that the fluid level has reached a predetermined point, which normally would be the fluid level is approaching the lower portion of container 32, actuator mechanism 98 extends actuator arm 100 and cam 80, causing bushing 78 to ride up inclined surface 82, thereby raising container 32 out of the remaining fluid in the trough.

This quick elevation of the container causes the film to be removed from the fluid as quickly as possible so that there is virtually no differential in processing time between various portions of the film. Because the fluid tends to drain more slowly when the trough is nearly empty due to the reduced fluid pressure in the trough, if the container was not elevated during the latter part of the drainage process, the portion of the film which is lowest in the container would be exposed to developer for a longer period than would the film which is positioned highest in the container. This differential is eliminated by the present system.

When all of the developer has been drained from the trough, the process is repeated for bleach, the first wash cycle, fix chemistry, the second wash cycle, and any additional steps which need to be performed. When bleach is being drained, because bleach is normally recycled, valve 141 is shifted to the position shown in phantom, directing the bleach through conduit 143 to the recovery system.

During washing steps, wash water is continuously pumped into the trough, overflowing into the weir openings 127. Because the level of fluid in the trough is somewhat higher during these wash steps, the DUMP period typically lasts 10 seconds longer than during the other processing steps to make sure that drainage is complete.

There are many advantages which are inherent in performing film processing in accordance with the preferred embodiment. A primary advantage is the virtually total uniform application of chemistry to the film.

The counter-rotating container and auger, with vanes 54 of the auger extending radially to a region proximal the film, produce extreme turbulence of the chemistry, which facilitates the even flow of the chemistry over the film. Also, container 32 is dropped into the rapidly rising level of fluid. This plunge causes further turbulence and promotes uniform application of chemistry. During processing with container 32 and auger assembly 40 counter-rotating, complete application of chemistry to the film is ensured. Reversing the direction of rotation is also helpful to this process. Finally, as fluid is being drained from the trough, an immediate elevation of the film out of the receding fluid level at an appropriate moment prevents one portion of the film from being exposed to chemistry for a greater period of time. Also, the temperature and time of processing are closely controlled in the processor, further ensuring uniform film treatment.

Controller Operation

Figure 10:
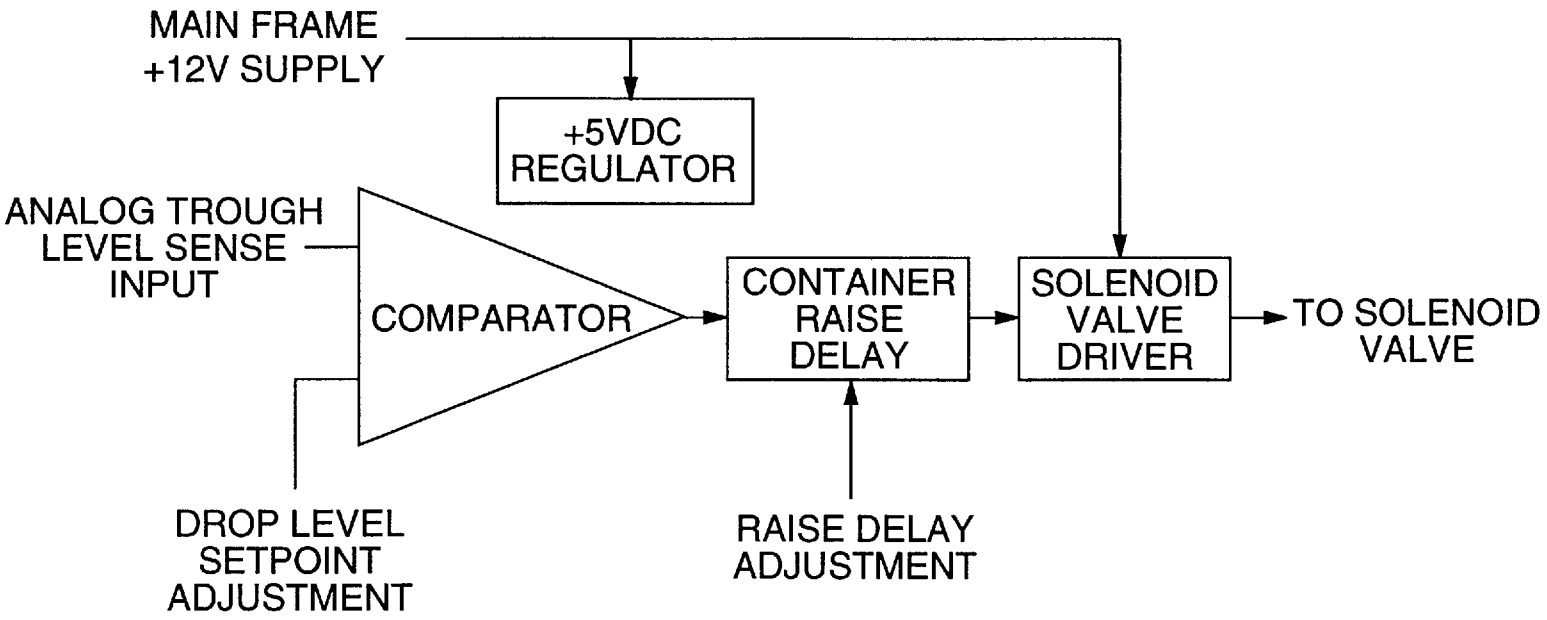
FIG. 10 is a schematic diagram of the control circuit of the embodiment of FIG. 1.
Figure 11:
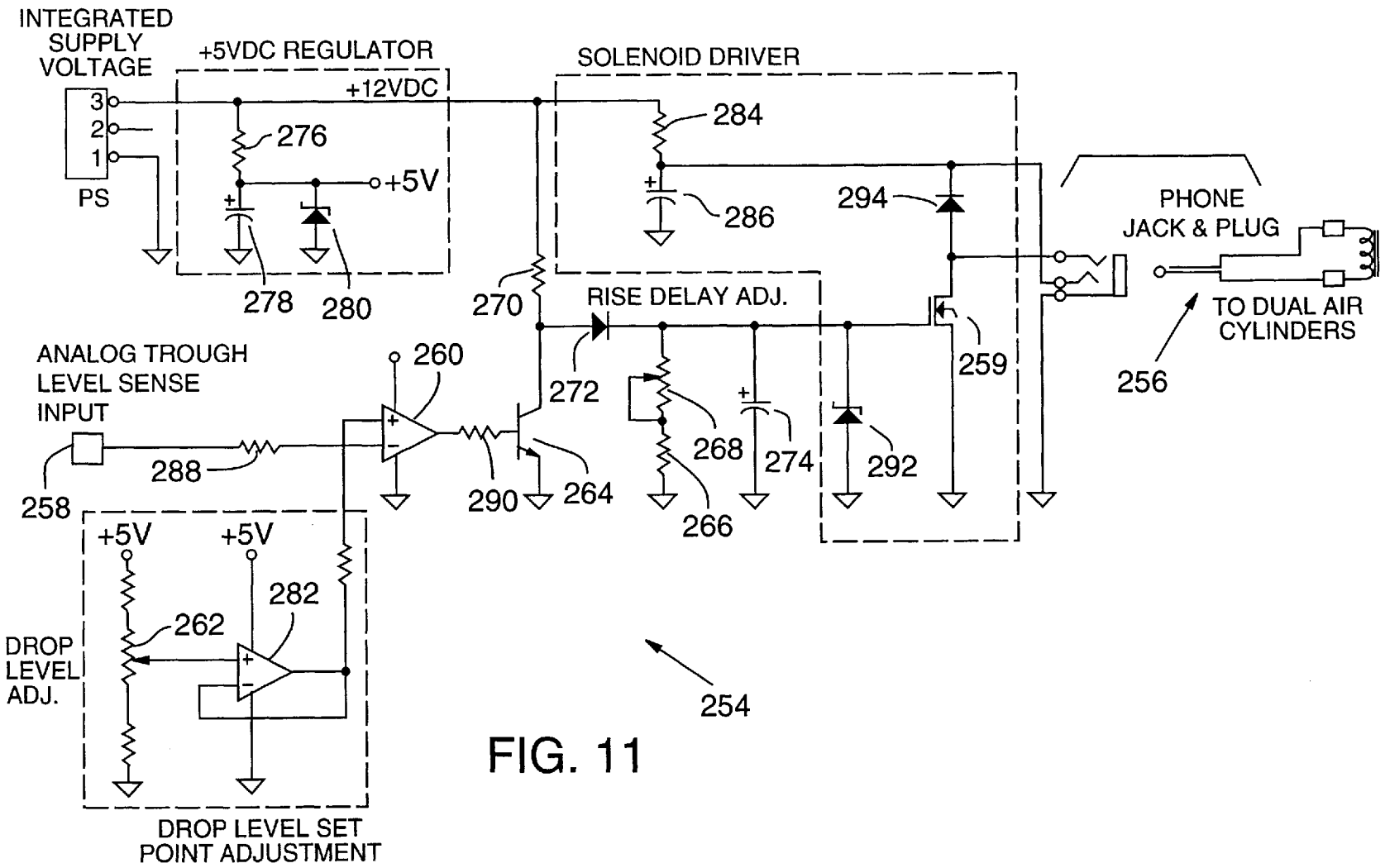
FIG. 11 is a circuit diagram of the control circuit of the embodiment of FIG. 1.

The cam actuator control circuit for controller 15 is illustrated schematically in FIG. 10 and as shown in greater detail in the circuit diagram of FIG. 11. The control circuit 254 requires only one analog input signal, and features only one output control signal. The input signal is an analog voltage ranging from 1.0 to 2.5 DC volts (V), which proportionally represents a fluid level in the trough of 0 to 2 inches. This output control signal is received from the level sensing transducer disposed in the bottom of the trough. The output control signal drives a 12V DC four-way solenoid valve 256 which in turn controls gas pressure to the dual air cylinders 103 which power actuator mechanism 98. This four-way solenoid valve 256 is typically in the form of a Humphrey Mini-Myte M41E1. Since 12V DC is supplied continuously to one side of the solenoid valve 256, output field FET (N-channel power MOSFET), conducts to actuate the solenoid valve, which in turn drops the container into the trough. When solenoid valve 256 is not conducting, the solenoid is de-energized and container 32 is in the raised position.

The solenoid valve and the air cylinders are not depicted in FIG. 3 in order to simplify that figure. But it should be understood that the operation of the solenoid controls the flow of nitrogen to the dual air cylinders, which controls the operation of the cam actuator mechanism.

The heart of cam actuator control circuit 254 is the analog comparator and solenoid valve driver combination. The comparator 258 is implemented via an operational amplifier 260. Assuming the trough 30 is empty at the beginning of an operation, the level sense input signal to the comparator is approximately 1.0V (negative comparator input). The adjustable threshold voltage input to the positive input of the comparator is derived from the drop level adjust potentiometer 262 and is somewhere between 1.40 and 1.83 V. Thus, the comparator output would be "high" under these input conditions. This high signal would cause transistor 264 to conduct and allow resistors 266 and 268 to keep the output drive FET 259 off. Thus, solenoid valve 256 is not energized and the container is retained in its elevated position.

As fluid rises in the trough during pumping and the level sense transducer signal rises as a result, it eventually equals and then exceeds the adjustable threshold voltage also present on the comparator inputs. When this happens, the output of the comparator goes "low" and causes transistor 264 to stop conducting. This action allows current to flow from the 12V DC supply through a resistor 270 and a diode 272, charging a capacitor 274 and eventually causing transistor 259 to conduct. This energizes solenoid valve 256, which ultimately causes the actuator mechanism to be actuated to its retracted position, causing the container to drop to its lowered position.

At the end of a processing step (during DUMP) when the level sense input signal drops, the reverse action occurs, except for the delay in initiating the lift operation caused by capacitor 274 discharging through resistors 266 and 268. Because resistor 268 is a potentiometer, this lift delay is adjustable by the operator.

The 5V DC regulator block in circuit 254 includes a resistor 276, a capacitor 278 and a diode 280. This circuit provides a 5.1V supply for the operational amplifiers 260 and 282 and drop level adjustable potentiometer 262.

The 12V DC supply voltage is not regulated. Therefore, a resistor 284 and a capacitor 286 are part of a solenoid valve driver block, and serve to isolate the 12V DC unregulated supply from undesirable current transients caused when solenoid valve 256 is energized. Also, operational amplifier 282 serves as a unity-gain buffer for the drop level adjustment threshold control.

Other components are depicted in FIGS. 10 and 11, and their function is evident in view of the circuit and the above description. Therefore, resistors 288 and 290, diodes 292 and 294 are provided.

Thus, the circuit provides for operation of the actuator mechanism by providing an analog input based upon the level of fluid in the trough. The two potentiometers 268 and 262 provide an adjustment to the delay in causing the container to rise and to drop, which is desirable in order to give the operator maximum flexibility and to enable the apparatus to be used for a wide variety of film processing operations. FIG. 9 schematically illustrates processing operations, and shows how the level adjustments provide this capability.

Other than as set forth above in connection with the description of control circuit 254, the controller operation of apparatus 10 is very similar to that set forth in our earlier U.S. Pat. No. 5,023,643. Thus, the description set forth at column 3, line 43-column 17, line 3, along with FIGS. 11–19B of our '643 patent, is incorporated herein by reference.

While the present invention has been shown and described with reference to the foregoing operational principles and preferred embodiment, it will be apparent to those skilled in the art that various changes in form and detail may be made without departing from the spirit and scope of the invention as defined by the appended claims.

It is claimed and desired to secure by Letters Patent:

1. A photo processor for developing film comprising:

a trough for holding film processing fluid;

a system for injecting the fluid into and draining the fluid from the trough;

a controller for controlling the operation of the fluid injection and drainage system;

a porous container for holding the film during processing operations, the container having a first drive shaft extending therethrough; and a turbulence-generating apparatus disposed within the container and rotatable with respect to the container, the apparatus being mounted to the drive shaft for rotation therewith.

2. The photo processor of claim 1 wherein the container is generally cylindrical and the turbulence-generating apparatus is in the form of an elongated structure having a plurality of longitudinally and radially extending vanes.

3. The photo processor of claim 2 wherein the elongated structure is an auger and the vanes extend radially outwardly to a region proximal the inner surface of the container.

4. The photo processor of claim 2 wherein the container is also mounted for rotation within the trough.

5. The photo processor of claim 4, further including a second drive shaft extending parallel to the first drive shaft for selectively rotating the container.

6. The photo processor of claim 5 wherein the second drive shaft is coaxial with the first drive shaft.

7. The photo processor of claim 6 wherein one of the drive shafts fits within and extends substantially the entire length of the other drive shaft.

8. The photo processor of claim 7 wherein each of the drive shafts includes a drive gear adjacent one end thereof, and the drive gears are adapted to rotate the container and the auger in opposite directions.

9. The photo processor of claim 8 wherein the drive gears of the two shafts are positioned adjacent opposite ends of the trough.

10. The photo processor of claim 1, further comprising a mechanism for supporting the first drive shaft actuable by the controller for selectively raising and lowering the container.

11. The photo processor of claim 10 wherein the mechanism includes two selectively actuable cams having cam surfaces which support the first drive shaft adjacent each end thereof.

12. The photo processor of claim 10 wherein each of the cams is reciprocable, and includes upper and lower surfaces for facilitating the raising and lowering of the container.

13. The photo processor of claim 12 wherein at least one substantially vertical slot is defined in the mechanism and wherein the first drive shaft extends through the vertical slot, thereby limiting the lateral movement of the shaft as the cams are reciprocated.

14. The photo processor of claim 1, further comprising a system for raising and lowering the container within the trough.

15. The apparatus of claim 1 wherein the controller raises the container as fluid is draining from the trough and lowers the container as fluid is being injected into the trough.

16. A processor for developing film comprising:

a chassis having a trough for holding developing chemistry;

a porous, elongated, rotatable container for holding the film to be developed within the trough;

a drive shaft extending through the container;

an actuable support for supporting the drive shaft adjacent each end thereof;

a system for actuating and thereby shifting the support between two positions which causes the drive shaft and the container to be vertically shifted between the two positions.

17. The processor of claim 16, further comprising turbulence-generating apparatus disposed within the container, the apparatus being rotatable with the drive shaft and with respect to the container.

18. The apparatus of claim 17 wherein the apparatus is an elongated structure having longitudinally vanes extending radially outwardly toward and into proximity with the container.

19. A process for developing film, comprising:

positioning the film to be developed in a porous container;

positioning the container over a trough;

injecting film-developing chemistry into the trough;

as chemistry is being injected into the trough, dropping the container into the trough;

agitating the chemistry in the trough; and after a predetermined period of time, draining chemistry from the trough.

20. The process of claim 19, further comprising the step of raising the container out of the trough as the chemistry is draining from the trough.

21. The process of claim 19, wherein the agitating step includes rotating the container within the chemistry.

22. The process of claim 19, further comprising the step of agitating the chemistry within the container in a manner independent of any agitation which might be taking place in the chemistry in the trough.

23. A process for developing film, comprising:

positioning the film to be developed in a porous container;

positioning the container over a trough;

injecting film-developing chemistry into the trough;

dropping the container into the trough;

agitating the chemistry in the trough;

after a predetermined period of time, draining chemistry from the trough, and as the chemistry is draining, raising the container out of the trough.

24. The process of claim 23, wherein the agitating step includes rotating the container within the chemistry.

25. The process of claim 23, further comprising the step of agitating the chemistry within the container in a manner independent of any agitation which might be taking place in the chemistry in the trough.

* * * * *